US011596971B2

(12) United States Patent
Iwai

(10) Patent No.: US 11,596,971 B2
(45) Date of Patent: Mar. 7, 2023

(54) COATING APPARATUS

(71) Applicant: OMRON Corporation, Kyoto (JP)

(72) Inventor: Yosuke Iwai, Nagoya (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/291,683

(22) PCT Filed: Oct. 18, 2019

(86) PCT No.: PCT/JP2019/041082
§ 371 (c)(1),
(2) Date: May 6, 2021

(87) PCT Pub. No.: WO2020/095653
PCT Pub. Date: May 14, 2020

(65) Prior Publication Data

US 2022/0001416 A1 Jan. 6, 2022

(30) Foreign Application Priority Data

Nov. 7, 2018 (JP) ..... JP2018-209956

(51) Int. Cl.
*B05C 11/10* (2006.01)
*B05C 5/02* (2006.01)

(52) U.S. Cl.
CPC ..... *B05C 11/1018* (2013.01); *B05C 5/0204* (2013.01)

(58) Field of Classification Search
USPC ..... 118/305, 323, 321, 687, 712, 679–681
See application file for complete search history.

(56) References Cited

U.S. PATENT DOCUMENTS 6,244,702 B1 * 6/2001 Sakino ..... B41J 2/14016 347/106
6,866,881 B2 * 3/2005 Prentice ..... B23K 3/0623 427/256

(Continued)

FOREIGN PATENT DOCUMENTS

DE 102014116830 A1 5/2016
JP H05108131 A 4/1993

(Continued)

OTHER PUBLICATIONS

English Translation JP2003-039000. (Year: 2001).*

(Continued)

*Primary Examiner* — Yewebdar T Tadesse
(74) *Attorney, Agent, or Firm* — Cantor Colburn LLP

(57) ABSTRACT

A coating apparatus includes a dispenser that includes a discharge port and a displacement sensor, the discharge port being configured to be capable of discharging liquid from a vertical direction the displacement sensor being configured to detect a distance in the vertical direction between the discharge port and the coating region, a drive device that drives the dispenser, a dispenser movement control unit that controls the drive device to move the dispenser along a predetermined coating path, a tilt detection unit that detects a tilt of the coating surface with respect to a reference plane based on the distance detected by the displacement sensor, and a coating path correction unit that corrects the coating path based on the tilt of the coating surface detected by the tilt detection unit.

10 Claims, 5 Drawing Sheets

(56) References Cited

U.S. PATENT DOCUMENTS

| | | | | |
|---|---|---|---|---|
| 9,707,584 | B2 * | 7/2017 | Giusti | B05D 1/02 |
| 2010/0262230 | A1 | 10/2010 | Vecerina et al. | |
| 2014/0245952 | A1 | 9/2014 | Vecerina et al. | |
| 2016/0008835 | A1 | 1/2016 | Giusti et al. | |
| 2017/0080452 | A1 | 3/2017 | Vecerina et al. | |

FOREIGN PATENT DOCUMENTS

| | | | |
|---|---|---|---|
| JP | H10211458 | A | 8/1998 |
| JP | 2000244107 | A | 9/2000 |
| JP | 2001000905 | A | 1/2001 |
| JP | 200339000 | A | 2/2003 |
| JP | 2004243215 | A | 9/2004 |
| JP | 2008023471 | A | 2/2008 |
| JP | 2010110700 | A | 5/2010 |
| JP | 3177944 | U | 8/2012 |
| JP | 106488806 | A | 3/2017 |
| WO | 2009065087 | A1 | 5/2009 |
| WO | 2017094563 | A1 | 6/2017 |

OTHER PUBLICATIONS

International Search Report for International Application No. PCT/JP2019/041082; dated Nov. 26, 2019.
Written Opinion of the International Searching Authority for International Application No. PCT/JP2019/041082; dated Nov. 26, 2019.
EPO Extended European Search Report for corresponding EP Application 19883256.0; dated Jul. 4, 2022.
CNIPA The First Office Action for corresponding CN Application No. 201980070738.6; dated Feb. 8, 2022.

* cited by examiner

COATING APPARATUS

CROSS REFERENCE TO RELATED APPLICATIONS

This is the U.S. national stage of application No. PCT/JP2019/041082, filed on Oct. 18, 2019. Priority under 35 U.S.C. § 119(a) and 35 U.S.C. § 365(b) is claimed from Japanese Application No. 2018-209956, filed Nov. 7, 2018, the disclosure of which is also incorporated herein by reference.

TECHNICAL FIELD

The present disclosure relates to a coating apparatus.

BACKGROUND ART

PTL 1 discloses a sealer coating apparatus for coating a peripheral edge portion of a windshield of an automobile with a sealer.

CITATION LIST

Patent Literature

PTL 1: JP 2004-243215 A

SUMMARY OF INVENTION

Technical Problem

In the sealer coating apparatus, the windshield is held by a work holding unit extending in the vertical direction from a belt conveyor moving along the horizontal plane so as not to be tilted with respect to the horizontal plane. Thus, when a positional deviation of the windshield in such a sealer coating apparatus is corrected, the rotational deviation of the windshield on the horizontal plane or the vertical deviation of the windshield usually is taken into consideration. However, tilting of the windshield with respect to the horizontal plane is not considered.

An object of the present disclosure is to provide a coating apparatus capable of accurately applying liquid to a predetermined position on a coating surface even if the coating surface is tilted with respect to the horizontal plane.

Solution to Problem

A coating apparatus as an example of the present disclosure including: a dispenser that includes a discharge port and a displacement sensor, the discharge port being configured to be capable of discharging liquid from a vertical direction to a coating region provided on a coating surface of an object to be coated, and the displacement sensor being configured to detect a distance in the vertical direction between the discharge port and the coating region;

a drive device that drives the dispenser;

a dispenser movement control unit that controls the drive device to move the dispenser along a predetermined coating path;

a tilt detection unit that detects a tilt of the coating surface with respect to a reference plane extending in a direction intersecting the vertical direction, based on the distance detected by the displacement sensor; and a coating path correction unit that corrects the coating path based on the tilt of the coating surface detected by the tilt detection unit, wherein when the coating path correction unit corrects the coating path, the dispenser movement control unit moves the dispenser along the corrected coating path.

Effects of the Invention

According to the coating apparatus, a tilt of the coating surface with respect to the reference plane extending in a direction intersecting the vertical direction is detected based on the distance detected by the displacement sensor, and the coating path is corrected based on the tilt of the detected coating surface. Such a configuration makes it possible to realize the coating apparatus capable of accurately applying liquid to a predetermined position (that is, the coating region) of the coating surface even if, for example, the object to be coated is not held and the coating surface is tilted with respect to the reference plane.

DESCRIPTION OF EMBODIMENTS

Hereinafter, an example of the present disclosure will be described with reference to the accompanying drawings. Note that, in the description below, terms indicating a specific direction or position (for example, terms including "top", "bottom", "right", and "left") are used as necessary. However, the use of those terms is for facilitating the understanding of the present disclosure with reference to the drawings, and the meaning of those terms does not limit the technical scope of the present disclosure. Further, the description below is merely exemplary in nature and is not intended to limit the present disclosure, its application, or its use. Furthermore, the drawings are schematic, and ratios and the like of dimensions do not necessarily agree with actual ones.

Figure 1:
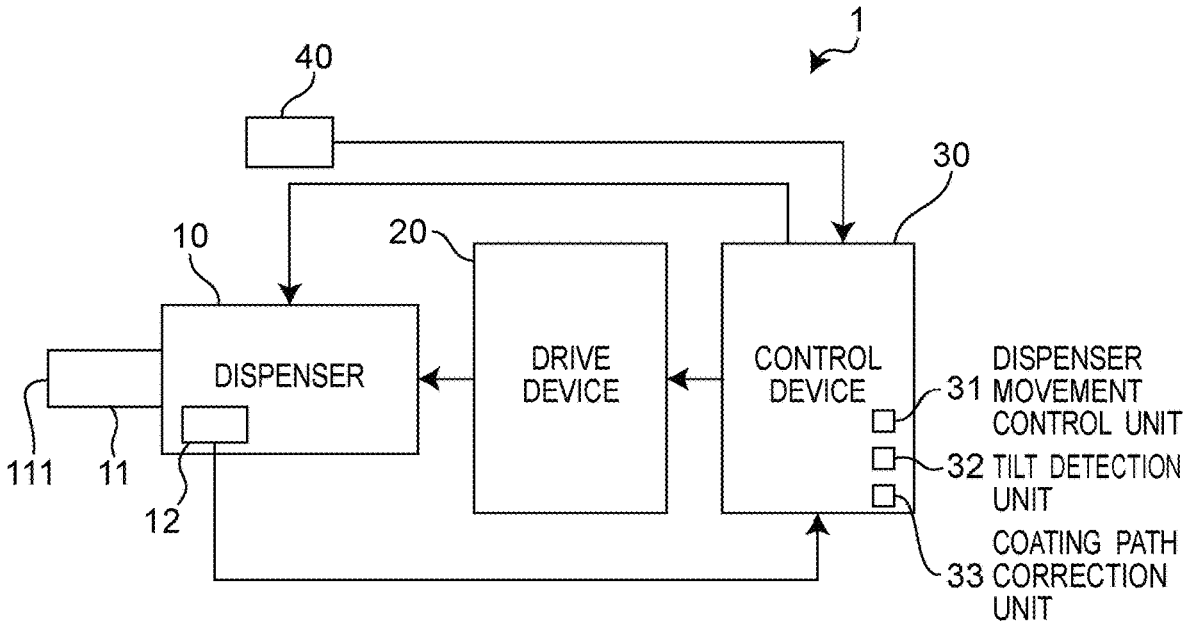
FIG. 1 is a block diagram illustrating a coating apparatus according to an embodiment of the present disclosure.

As shown in FIG. 1, a coating apparatus 1 according to an embodiment of the present disclosure includes a dispenser 10, a drive device 20 capable of driving the dispenser 10, and a control device 30 that controls the dispenser 10 and the drive device 20.

Figure 2:
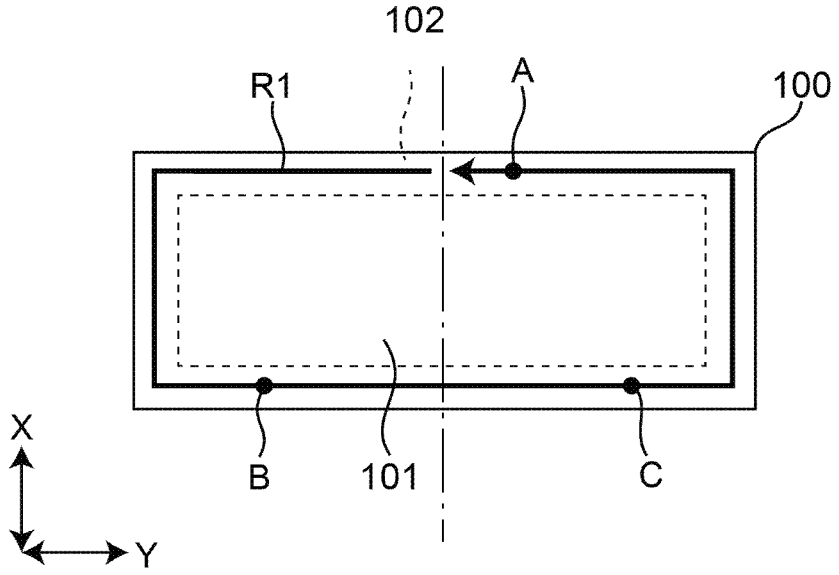
FIG. 2 is a plan view illustrating a coating path of a reference object to be coated.
Figure 3:
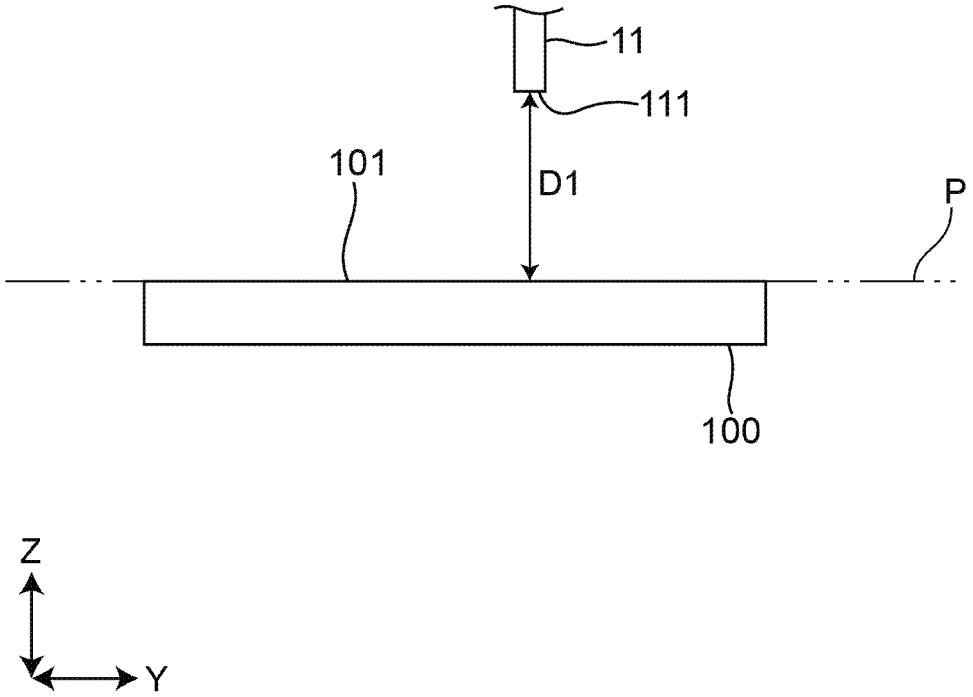
FIG. 3 is a side view of the reference object to be coated.

As shown in FIG. 1, the dispenser 10 includes a nozzle 11 and a displacement sensor 12. As shown in FIGS. 2 and 3, the nozzle 11 include a discharge port 111 capable of discharging liquid from the vertical direction Z to a coating region 102 provided on an outer peripheral edge of a coating surface 101 of an object 100 to be coated. As shown in FIG. 3, the displacement sensor 12 detects a distance D in the vertical direction Z between the discharge port 111 and the coating region 102 of the coating surface 101. FIGS. 2 and 3 illustrate a plate-shaped object 100 to be coated on which the substantially rectangular coating surface 101 is arranged along the horizontal plane XY.

The dispenser 10 is, for example, an air pulse type dispenser that can use a liquid material having any desired viscosity (Pa·s) (for example, alcohol having a viscosity less than 0.001 or cream solder having a viscosity exceeding 100) as the liquid discharged from the discharge port 111. In the dispenser 10, when the nozzle 11 is tilted with respect to the vertical direction, a discharge amount of liquid discharged from the discharge port 111 is more likely to vary. This variation becomes more conspicuous as the viscosity of the liquid decreases. For this reason, the nozzle 11 is arranged along the vertical direction Z, and the discharge port 111 is arranged so that the liquid can be discharged from the vertical direction Z to the coating region 102.

The drive device 20 is, for example, a robot, and configured to be movable in the horizontal directions X and Y (see FIG. 2) and the vertical direction Z (see FIG. 3) by holding the dispenser 10 in a state where liquid can be discharged in the vertical direction Z from the discharge port 111.

The control device 30 includes a CPU that performs calculation and the like, a storage medium such as a ROM, RAM, and the like for storing a program or data necessary for controlling the dispenser 10 and the drive device 20, and an interface unit that performs input and output of a signal to and from an external unit (not shown). As shown in FIG. 1, the control device 30 includes a dispenser movement control unit 31, a tilt detection unit 32, and a coating path correction unit 33. The dispenser movement control unit 31, the tilt detection unit 32, and the coating path correction unit 33 are functions realized by the CPU of the control device 30 executing a predetermined program.

The dispenser movement control unit 31 moves the dispenser 10 along a predetermined coating path R1 for each of the object 100 to be coated. Further, when the coating path R1 is corrected by the coating path correction unit 33 as described later, the dispenser movement control unit 31 moves the dispenser 10 along a corrected coating path R2 (see FIG. 4).

The tilt detection unit 32 detects a tilt θ of the coating surface 101 with respect to a reference plane P (a horizontal plane in the present embodiment) extending in a direction intersecting the vertical direction Z (see FIG. 5) based on the distance D detected by the displacement sensor 12. Specifically, the tilt detection unit 32 detects the tilt θ around a rotation axis 110 extending in the X direction on the coating surface 101 based on a reference distance D1 and a distance D2. The reference distance D1 is detected in advance in at least three preset locations (for example, points A, B, and C shown in FIG. 2) that are at the outer peripheral edge of the coating surface 101 of the reference object 100 to be coated and are on the coating path R1. The distance D2 is detected in at least three preset locations (that is, points A, B, and C shown in FIG. 4) that are at the outer peripheral edge of the coating surface 101 of the object 100 to be coated and are on the coating path R1. In the present embodiment, the object 100 to be coated shown in FIGS. 2 and 3 (that is, the object 100 to be coated in which the coating surface 101 is horizontally arranged) is used as the reference object 100 to be coated. The reference distance D1 and the distance D2 are the distance D detected in a state where the discharge port 111 is at the same position with respect to the reference plane P in the vertical direction Z. The reference plane P is not limited to the horizontal plane, and is set according to the position and attitude of the reference object 100 to be coated.

Figure 4:
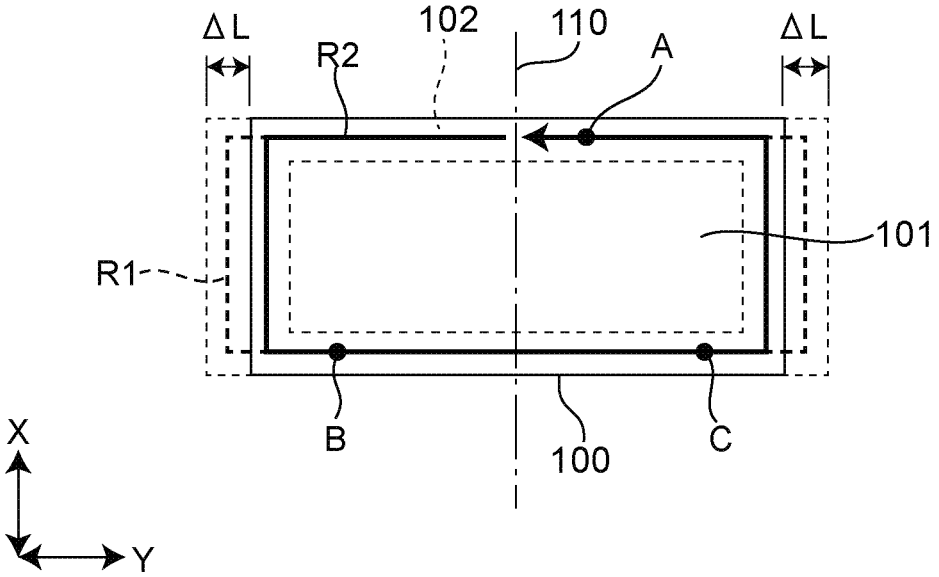
FIG. 4 is a plan view illustrating a corrected coating path of an object to be coated.
Figure 5:
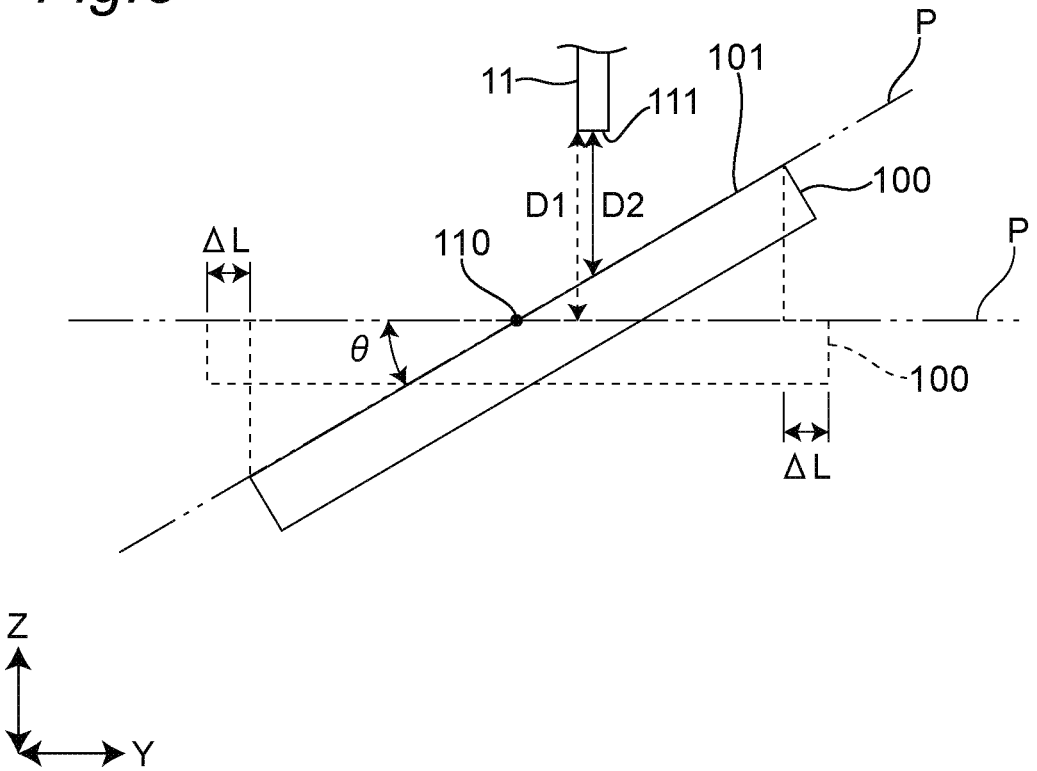
FIG. 5 is a side view of the object to be coated.

The coating path correction unit 33 corrects the coating path R1 based on the tilt θ of the coating surface 101 detected by the tilt detection unit 32. For example, when the coating surface 101 is tilted by an angle θ around the rotation axis 110, the coating surface 101 viewed from the vertical direction Z, which is the liquid discharge direction, becomes smaller by ΔL×2 in the Y direction, as shown in FIGS. 4 and 5. Thus, the coating path correction unit 33 corrects a length of the coating path R1 in the Y direction according to the tilt θ of the coating surface 101 detected by the tilt detection unit 32 to create the coating path R2.

The coating apparatus 1 includes an image sensor 40 that detects a position and attitude of the object 100 to be coated. The control device 30 sets the coating path R1 based on the position and attitude of the reference object 100 to be coated detected by the image sensor 40.

Next, the coating processing using the coating apparatus 1 will be described with reference to FIG. 6. Note that the processing described below is performed by the control device 30 executing a predetermined program.

Figure 6:
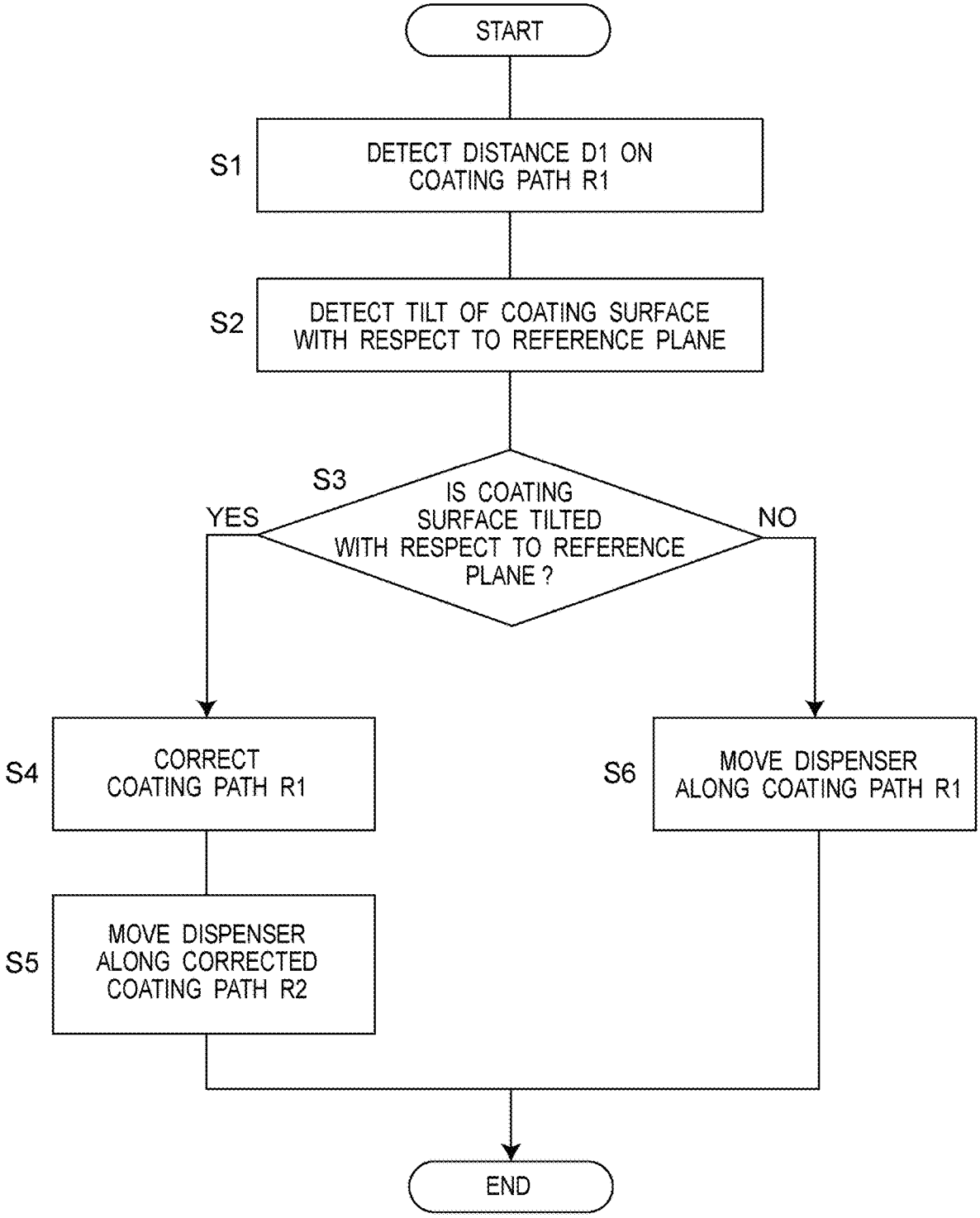
FIG. 6 is a flowchart for explaining coating processing of the coating apparatus of FIG. 1.

As shown in FIG. 6, first, the dispenser movement control unit 31 moves the dispenser 10 along the coating path R1 preset based on the position and attitude of the reference object 100 to be coated detected by the image sensor 40. Then, the displacement sensor 12 detects the distance D2 in the vertical direction Z between the discharge port 111 and the coating surface 101 in at least three preset locations that are at the outer peripheral edge of the coating surface 101 and are on the coating path R1 (Step S1).

When the distance D2 is detected, the tilt detection unit 32 detects the tilt θ of the coating surface 101 with respect to the reference plane P based on the detected distance D2 and the preset reference distance D1 (Step S2). Then, the control device 30 determines whether the coating surface 101 is tilted with respect to the reference plane P based on whether the tilt detection unit 32 detects the tilt θ of the coating surface 101 with respect to the reference plane P (Step S3).

When it is determined that the coating surface 101 is tilted with respect to the reference plane P, the coating path correction unit 33 corrects the coating path R1 based on the detected tilt θ of the coating surface 101 with respect to the reference plane P (Step S4). Then, the dispenser movement control unit 31 moves the dispenser 10 along the corrected coating path R2 (Step S5). When it is determined that the coating surface 101 is not tilted with respect to the reference plane P, the dispenser movement control unit 31 moves the dispenser 10 along the coating path R1 (Step S6).

In Steps S6 and S7, when the dispenser 10 is moving on the coating path R1 and R2, the control device 30 controls the dispenser 10 to discharge liquid from the discharge port 111 of the nozzle 11 toward the coating region 102. Then, when the application of the liquid to the coating region 102 is completed, the coating processing is completed.

According to the coating apparatus 1, the tilt θ of the coating surface 101 with respect to the reference plane P extending in the direction intersecting the vertical direction Z is detected based on the distance D detected by the displacement sensor 12, and the coating path R1 is corrected based on the tilt θ of the detected coating surface 101. Such a configuration makes it possible to realize the coating apparatus 1 capable of accurately applying liquid to a predetermined position (that is, the coating region 102) of the coating surface 101 even if, for example, the object 100 to be coated is not held and the coating surface 101 is tilted with respect to the reference plane.

The tilt detection unit 32 detects the tilt of the coating surface 101 based on the distance D1 and D2 detected in at least three locations that are at the outer peripheral edge of the coating surface 101 and are on the coating path R1 and R2. With such a configuration, the tilt θ of the coating surface 101 with respect to the reference plane P can be detected more accurately.

The tilt detection unit 32 may detect the tilt of the coating surface 101 based on the distance D1 and D2 detected in two locations on the coating path R1 and R2. The locations on the coating path R1 and R2 in which the distance D1 and D2 is detected by the tilt detection unit 32 may not be at the outer peripheral edge of the coating surface 101.

Figure 7:
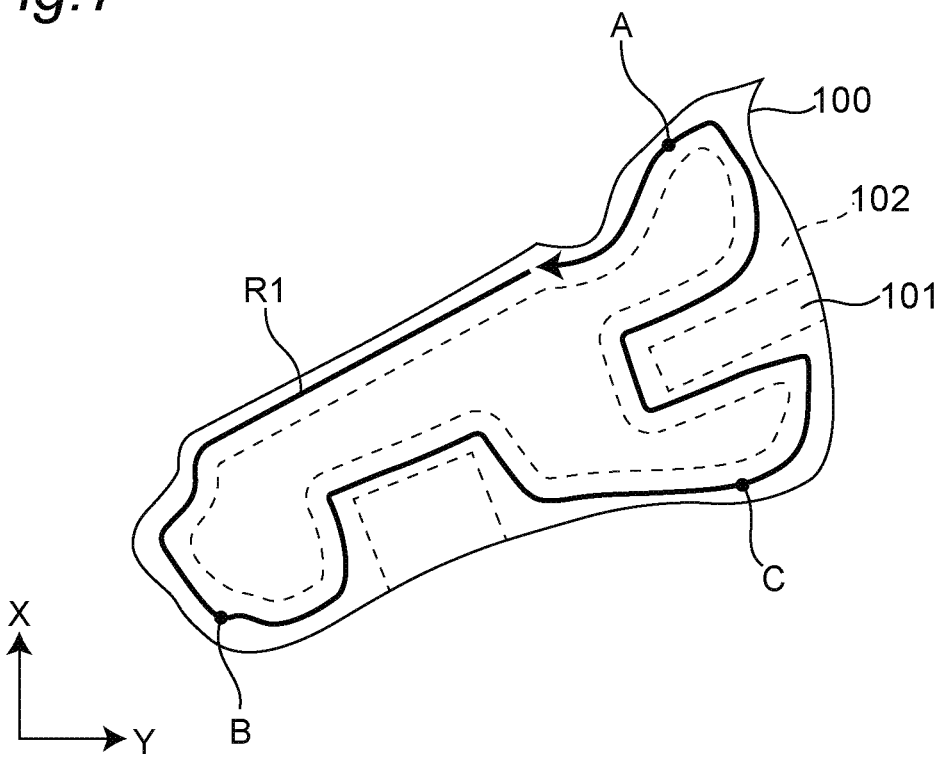
FIG. 7 is a plan view of another object to be coated.
Figure 8:
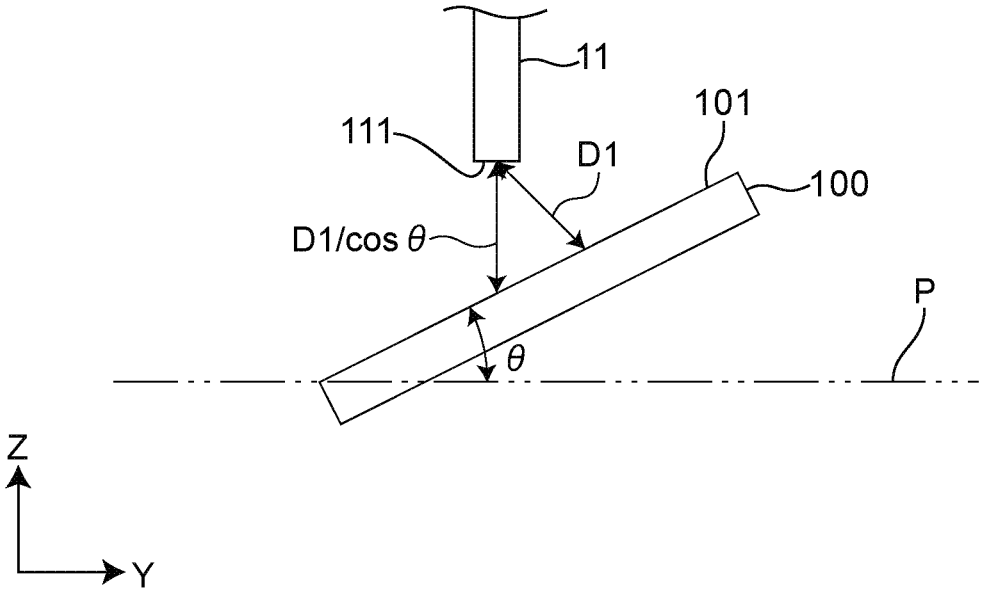
FIG. 8 is a side view for explaining a variation of the coating apparatus of FIG. 1.

As shown in FIG. 7, the coating surface 101 is not limited to a substantially rectangular shape, and may have any desired shape. The coating region 102 is not limited to the outer peripheral edge of the coating surface 101, and may be set to any other area.

The dispenser movement control unit 31 may be configured to move the dispenser 10, when the coating surface 101 is tilted with respect to the reference plane P, at a speed different from that when the coating surface 101 is not tilted with respect to the reference plane P. For example, when the discharge amount of liquid discharged from the nozzle 11 is constant, the reference plane P is the horizontal plane, and the coating surface 101 is tilted with respect to the horizontal plane, the dispenser 10 is moved at a speed lower that when the coating surface 101 is horizontal. Specifically, assuming that the moving speed of the dispenser 10 when the coating surface 101 is horizontal is V and the coating surface 101 is tilted by the angle θ with respect to the horizontal plane, the dispenser movement control unit 31 moves the dispenser 10 at the speed of VCosθ. In this manner, a line having substantially the same width as a reference line formed by liquid discharged along the coating path R1 of the reference object 100 to be coated can be formed on the corrected coating path R2 of the object 100 to be coated.

The dispenser movement control unit 31 may be configured to move the dispenser 10, when the tilt of the coating surface 101 with respect to the reference plane P detected by the tilt detection unit 32 is equal to or more than a threshold value, at a speed different from that when the coating surface 101 is not tilted with respect to the reference plane P. In this manner, the coating processing can be simplified and the load applied on the control device 30 when performing the coating processing can be reduced. The threshold value is decided from the viewpoint of, for example, whether it is possible, even if the coating surface 101 is tilted with respect to the reference plane P, to draw the substantially same coating track as that when the coating surface 101 is not tilted with respect to the reference plane P.

Assuming that the coating surface 101 is tilted by the angle θ with respect to the horizontal plane, the dispenser movement control unit 31 may be configured to move the dispenser 10 along the corrected coating path R2 so that the discharge port 111 is located at a position separated from the coating surface 101 by a distance D1/Cos θ in the vertical direction Z. In this manner, a line having substantially the same width as a reference line formed by liquid discharged on the coating path R1 of the reference object 100 to be coated can be formed on the coating path R2 of the object 100 to be coated.

The coating apparatus 1 may be configured to be able to correct not only the deviation of the coating surface 101 with respect to the tilt θ with respect to the reference plane P, but also a rotational deviation on the horizontal plane and a deviation in the vertical direction. For example, the position and attitude of the reference object 100 to be coated detected by the image sensor 40 can be set as a reference position and a reference attitude. The rotational deviation on the horizontal plane and the deviation in the vertical direction can be detected based on the reference position and the reference attitude as well as on the position and the attitude of the object 100 to be coated detected by the image sensor 40.

The various embodiments of the present disclosure have been described in detail with reference to the drawings and, finally, various aspects of the present disclosure will be described. Note that, reference numerals are added in the description below as an example.

A coating apparatus 1 of a first aspect of the present disclosure includes:

a dispenser 10 that includes a discharge port 111 and a displacement sensor 12, the discharge port 111 being configured to be capable of discharging liquid from a vertical direction Z to a coating region 102 provided on a coating surface 101 of an object 100 to be coated, and the displacement sensor 12 being configured to detect a distance D1 and D2 in the vertical direction Z between the discharge port 111 and the coating region 102;

a drive device 20 that drives the dispenser 10;

a dispenser movement control unit 31 that controls the drive device 20 to move the dispenser 10 along a predetermined coating path R1;

a tilt detection unit 32 that detects a tilt of the coating surface 101 with respect to a reference plane P extending in a direction intersecting the vertical direction Z, based on the distance D1 and D2 detected by the displacement sensor 12; and a coating path correction unit 33 that corrects the coating path R1 based on the tilt of the coating surface 101 detected by the tilt detection unit 32, wherein when the coating path correction unit 33 corrects the coating path R1, the dispenser movement control unit 31 moves the dispenser 10 along the corrected coating path R2.

According to the coating apparatus 1 of the first aspect, the tilt θ of the coating surface 101 with respect to the reference plane P extending in the direction intersecting the vertical direction Z is detected based on the distance D detected by the displacement sensor 12, and the coating path R1 is corrected based on the tilt θ of the detected coating surface 101. Such a configuration makes it possible to realize the coating apparatus 1 capable of accurately applying liquid to a predetermined position (that is, the coating region 102) of the coating surface 101 even if, for example, the object 100 to be coated is not held and the coating surface 101 is tilted with respect to the reference plane.

In the coating apparatus 1 of a second aspect of the present disclosure, the tilt detection unit 32 detects the tilt of the coating surface 101 based on the distance D1 and D2 detected in at least three locations that are at an outer peripheral edge of the coating surface 101 and are on the coating path R1 and R2.

According to the coating apparatus 1 of the second aspect, the tilt θ of the coating surface 101 with respect to the reference plane P can be detected more accurately.

In the coating apparatus 1 of a third aspect of the present disclosure, when the coating surface 101 is tilted with respect to the reference plane P, the dispenser movement control unit 31 moves the dispenser 10 at a speed different from that when the coating surface 101 is not tilted with respect to the reference plane P.

According to the coating apparatus 1 of the third aspect, a line having substantially the same width as a reference line formed by liquid discharged along the coating path R1 of the reference object 100 to be coated can be formed on the corrected coating path R2 of the object 100 to be coated.

In the coating apparatus 1 of a fourth aspect of the present disclosure, when the tilt of the coating surface 101 with respect to the reference plane P detected by the tilt detection unit 32 is equal to or more than a threshold value, the dispenser movement control unit moves the dispenser at a speed different from that when the coating surface 101 is not tilted with respect to the reference plane P.

According to the coating apparatus 1 of the fourth aspect, the coating processing can be simplified and the load applied on the control device 30 when performing the coating processing can be reduced.

In the coating apparatus 1 of a fifth aspect of the present disclosure, when the reference plane P is a horizontal plane and the coating surface 101 is tilted with respect to the horizontal plane, the dispenser movement control unit 31 moves the dispenser 10 at a speed lower than that when the coating surface 101 is horizontal.

According to the coating apparatus 1 of the fifth aspect, a line having substantially the same width as that of a reference line formed by liquid discharged along the coating path R1 of the reference object 100 to be coated can be formed on the corrected coating path R2 of the object 100 to be coated.

Note that, by appropriately combining any embodiment or variation of the various embodiments or variations, the effect of each of them can be achieved. Further, a combination of embodiments, a combination of examples, or a combination of an embodiment and an example is possible, and a combination of features in different embodiments or examples is also possible.

Although the present disclosure is sufficiently described in connection with preferred embodiments with reference to the accompanying drawings, various variations and modifications are obvious to those skilled in the art. It should be understood that such variations and modifications are included within the scope of the present disclosure in the appended claims as long as they do not deviate from the scope.

INDUSTRIAL APPLICABILITY

The coating apparatus of the present disclosure can be used, for example, for coating a windshield with a sealer.

REFERENCE SIGNS LIST

1. coating apparatus
10. dispenser
11. nozzle
111. discharge port
12. displacement sensor
20. drive device
30. control device
31. dispenser movement control unit
32. tilt detection unit
33. coating path correction unit
40. image sensor
100. object to be coated
101. coating surface
102. coating region
110. rotation axis
R1, R2. coating path
P. reference plane

The invention claimed is:

1. A coating apparatus comprising:

a dispenser that includes a discharge port and a displacement sensor, the discharge port being configured to be capable of discharging liquid from a vertical direction to a coating region provided on a coating surface of an object to be coated, and the displacement sensor being configured to detect a distance in the vertical direction between the discharge port and the coating region;

a drive device that drives the dispenser; and a control device that controls the dispenser and the drive device, wherein the control device including:

a dispenser movement control unit that controls the drive device to move the dispenser along a length of a predetermined coating path;

a tilt detection unit that detects a tilt of the coating surface with respect to a reference plane extending in a direction intersecting the vertical direction, based on the distance detected by the displacement sensor; and a coating path correction unit that corrects the length of the predetermined coating path based on the tilt of the coating surface detected by the tilt detection unit, wherein when the coating path correction unit corrects the length of the predetermined coating path, the dispenser movement control unit moves the dispenser along the corrected length of the predetermined coating path.

2. The coating apparatus according to claim 1, wherein the tilt detection unit detects the tilt of the coating surface based on the distance detected in at least three locations that are at an outer peripheral edge of the coating surface and are on the predetermined coating path.

3. The coating apparatus according to claim 2, wherein when the coating surface is tilted with respect to the reference plane, the dispenser movement control unit moves the dispenser at a speed different from that when the coating surface is not tilted with respect to the reference plane.

4. The coating apparatus according to claim 3, wherein when the tilt of the coating surface with respect to the reference plane detected by the tilt detection unit is equal to or more than a threshold value, the dispenser movement control unit moves the dispenser at a speed different from that when the coating surface is not tilted with respect to the reference plane.

5. The coating apparatus according to claim 4, wherein when the reference plane is a horizontal plane and the coating surface is tilted with respect to the horizontal plane, the dispenser movement control unit moves the dispenser at a speed lower than that when the coating surface is horizontal.

6. The coating apparatus according to claim 3, wherein when the reference plane is a horizontal plane and the coating surface is tilted with respect to the horizontal plane, the dispenser movement control unit moves the dispenser at a speed lower than that when the coating surface is horizontal.

7. The coating apparatus according to claim 1, wherein when the coating surface is tilted with respect to the reference plane, the dispenser movement control unit moves the dispenser at a speed different from that when the coating surface is not tilted with respect to the reference plane.

8. The coating apparatus according to claim 7, wherein when the tilt of the coating surface with respect to the reference plane detected by the tilt detection unit is equal to or more than a threshold value, the dispenser movement control unit moves the dispenser at a speed different from that when the coating surface is not tilted with respect to the reference plane.

9. The coating apparatus according to claim 8, wherein when the reference plane is a horizontal plane and the coating surface is tilted with respect to the horizontal plane, the dispenser movement control unit moves the dispenser at a speed lower than that when the coating surface is horizontal.

10. The coating apparatus according to claim 7, wherein when the reference plane is a horizontal plane and the coating surface is tilted with respect to the horizontal plane, the dispenser movement control unit moves the dispenser at a speed lower than that when the coating surface is horizontal.

* * * * *